United States Patent [19]

Witte

[11] 4,439,961

[45] Apr. 3, 1984

[54] LEVELING AND LOCATING DEVICE AND METHOD OF USING

[76] Inventor: Donald H. Witte, 7331 Oakbluff, Dallas, Tex. 75240

[21] Appl. No.: 317,600

[22] Filed: Nov. 3, 1981

[51] Int. Cl.[3] ..... E04D 15/00; E04G 21/00

[52] U.S. Cl. ..... 52/126.1; 52/126.3; 52/169.8; 52/741

[58] Field of Search ..... 52/126.1, 126.3, 126.5, 52/155, 169.7, 169.8, 677; 254/104

[56] References Cited

U.S. PATENT DOCUMENTS

| | | | |
|---|---|---|---|
| 1,535,487 | 4/1925 | Luschenowsky | 254/104 |
| 1,541,971 | 4/1924 | Lampert | 254/104 |
| 2,123,484 | 7/1938 | Mafera | 254/104 |

FOREIGN PATENT DOCUMENTS

| | | | |
|---|---|---|---|
| 541050 | 3/1956 | Italy | 52/607 |

*Primary Examiner*—Alfred C. Perham
*Assistant Examiner*—Mark J. Sofia
*Attorney, Agent, or Firm*—Kanz, Scherback & Timmons

[57] ABSTRACT

A leveling and locating or positioning device is disclosed which includes a force-bearing structure which is guided for vertical leveling movement by a vertical reference device which also provides a horizontal position reference. Horizontal movement of a tapered wedge device, which operatively interfaces with a sloped floor member of the force-bearing structure, causes vertical movement of the force-bearing structure and the resulting leveling function. A horizontal extender device, slidably mounted to and supported by the force-bearing structure, provides the horizontal locating or positioning function. A support device is operatively included or mounted to one end of the horizontal extender device and is configured to operatively interface with the member or device which is to be leveled and located or positioned.

10 Claims, 6 Drawing Figures

LEVELING AND LOCATING DEVICE AND METHOD OF USING

BACKGROUND OF THE INVENTION

The present invention relates in general to the leveling and locating or positioning of forms or support structures of the type generally associated with the construction industry, and more particularly, to new and improved apparatus for leveling and locating or positioning forms or wall structures associated with modular swimming pools.

Although the present invention is applicable to the leveling and locating of various items or members used both in and out of the construction-type industry, it has been found particularly useful in the environment of modular component swimming pools. Therefore, without limiting the applicability of the invention to "swimming pools," the invention will be described in this environment.

In the construction-type industry in particular, most projects start with a reference which is determined to be or is constructed to be level. The need for and use of a level reference is mainly for functional reasons and purposes but is also for aesthetic as well as human safety and convenience reasons. Probably the oldest means for leveling a small structure or member is to place lifts or risers under the low spot or spots or to remove a portion or portions of the support means (the earth, frame foundation, etc.) which is located under and is supporting the high or low point or points of the structure or member to be leveled. This leveling process usually consists of a trial and error method including the lifting or removing of the structure or member while the height or thickness of the support means (the earth, frame foundation, etc.) is decreased or increased and then the structure or member is replaced and the structure is checked for levelness with the sequence being repeated until the structure is level.

One of the typical small structures which needs to be leveled during its construction and installation is a swimming pool. In a modular component swimming pool wall structures, there are several items which need to be leveled. The most important items include the panel sections comprising the support wall located around the periphery of the pool which provides support for such items as the deck, the coping, the skimmers and over-flow outlets, the steps for entering and leaving the pool, the water-return lines, and the light fixtures. These items need to be level for functional, aesthetic and safety reasons as well as to provide structural integrity to the over-all pool structure.

In the construction and placement of the modular component swimming pool, there are many steps involved. A few of those steps which are relevant to the invention as claimed will be briefly discussed. Normally, the first step is to establish on the property, the final deck level or surface grade of the site chosen for the pool. A contractor level can be used to determine this grade. The next step is to layout, on the surface grade, the pool perimeter profile for the particular pool shape to be installed. Excavation of the pool area within the perimeter profile is then performed. During this excavation of the pool area, a 12 inch to 36 inch overdig area is completed outwardly from the pool profile. This overdig area is excavated only to a depth generally equal to the height of the panel sections to be used to provide the wall around the pool perimeter. This overdig area provides a shelf-type area external to the pool profile excavation with the floor of the overdig area being below ground level by the height of the panel sections to be joined to form the wall around the pool perimeter. This shelf-type area provides the general support surface for the panel sections. The panel sections are generally 2 to 12 feet in length with a bracing apparatus located intermittently behind each panel section and extending at right angles to the panel sections. When the panel sections are fastened together to form the pool perimeter, the braces extend outwardly from the pool perimeter. The top of each panel section must be level in order to form a level line around the pool perimeter.

To assure that the panel sections will be level when installed around the pool perimeter, a level surface or floor must be provided on which to set or place the panel sections. In the prior art, this surface is provided by several methods, one of which is using blocks, such as concrete patio blocks or firm pads. These blocks vary in thickness. The blocks must be located and placed at intervals, on the shelf-type area. Each block must be firmly set into the excavated shelf-type surface and be positioned and leveled such that the top surface of each block is level and is within plus or minus ⅛ inch or even closer of a predetermined level height dimension with respect to the final deck level. In the leveling of the blocks, some blocks will require dirt to be removed from beneath the block while other blocks will require dirt to be added beneath the block. Addition and/or subtraction of dirt often results in an unfirm leveled surface, i.e., settles from rain, etc. The process will be a trial and error event and will require the use of a contractors level. The completed wall comprising the individual panel sections (with attached brace sections) which have been fastened together, is positioned on the leveled blocks. Besides being level, each panel section must be positioned with respect to the adjoining sections to form a smooth plane so the completed pool wall will comprise a straight and smooth plane. Certain portions of the various panel sections may need to be moved toward or away from the pool excavation to obtain the smooth plane and care must be taken to not move or disturb the blocks upon which the sections are resting. When properly positioned, each leveled block under the panel sections comprising the pool wall will normally protrude some distance into the pool area.

After the completed pool wall has been positioned and aligned properly on the level blocks, anchor rods are often positioned through prepared locations in the panel sections and the brace sections with the rods then being driven into the earth. Then a concrete footing placement is poured with concrete being placed 4 to 6 inches high on the back side of the panel sections, on both sides of the brace sections, on the anchor rods and the leveled blocks. Some of the concrete will fill the space between the surface of the earth and the bottom edge of the panel sections and the brace sections. This concrete footing placement securely anchors the wall structure. The force from the placement of the concrete footing often disturbs and moves the bottom positioned edge of the wall panel sections resulting in an undesirable misaligned wall perimeter system. After the concrete footing placement has at least partially cured, the portion of the leveled blocks which protrudes into the pool area must be broken-off before pool bottom finish is placed in the pool excavation.

Positioned at predetermined locations in the wall of panel sections are special sections which include the skimmers and overflow outlets, the steps for entering and leaving the pool, the water return outlets, the light fixtures, etc. Also, the top edge of the pool wall is the reference for the integral deck and coping of the pool. So it is readily apparent that it is extremely important that the top edge of the wall is level for functional as well as for safety and aesthetic reasons.

The additional steps needed to complete the pool will not be discussed since those steps are not pertinent to the presently claimed invention.

The invention as claimed is intended to provide a solution for various prior art deficiencies including the time consuming tasks of obtaining numerous concrete blocks for leveling purposes, then positioning each block at an intermittent location and then leveling each block while maintaining the blocks within at least ⅛ inch of a predetermined height. Also, the blocks must be positioned such that they remain level and at the predetermined height after the panel sections have been fastened together to form the pool perimeter wall and positioned on the blocks. After the concrete footing placement has partially cured, the portion of the blocks protruding into the pool area must be broken off so the blocks will not protrude above the finished bottom surface of the pool.

SUMMARY OF A PREFERRED EMBODIMENT OF THE INVENTION

The present invention provides a means for leveling and positioning or locating the pool wall, as well as other construction type forms or items, with greater ease and accuracy and in much less time than the prior art. A leveling and locating or positioning device is provided which includes a force-bearing block or structure which is guided for vertical movement by a vertical reference device. The vertical reference device is anchored into the ground and also provides a horizontal position reference. Horizontal movement of a tapered wedge means, which operatively interfaces with a sloped floor member of the force bearing structure, causes vertical movement of the force-bearing structure and the resulting leveling function. A horizontal extender means, which is slidably mounted to and supported by the force-bearing structure, provides the horizontal locating or positioning function. A support device is operatively included or mounted to one end of the horizontal extender device and is configured to operatively interface with the pool panel or whatever member or device which is to be leveled and located or positioned. After the leveling and locating function is completed, fastening means locks the various movable elements of the leveling and locating device securely together and in position to preserve the location of the particular member or device which has been leveled and located.

Among the advantages offered by the claimed invention is the elimination of the need for the concrete blocks, their accurate positioning and leveling and the breaking-off of the portion of the blocks which protruded into the pool excavation thereby greatly reducing the time needed for the positioning and leveling of the pool wall. The claimed invention may be located using less time but with more accuracy than the prior art blocks and can level and locate the pool wall to form the smooth plane surface more easily, more securely, and more accurately than the prior art blocks. Also, much better absolute control of the final position is possible by use of the claimed invention.

A number of the more important features and advantages of this invention have thus been summarized rather broadly in order that the detailed description thereof that follows may be better understood and in order that the contribution to the art may be better appreciated. There are, of course, additional features of the invention which will be described hereinafter and which will also form the subject of the claims appended hereto. Other features of the present invention will become apparent with reference to the following detailed description of a presently preferred embodiment thereof, for carrying out the invention, in connection with the accompanying drawing, wherein like reference numerals have been applied to like elements, in which:

DETAILED DESCRIPTION OF A PREFERRED EMBODIMENT OF THE INVENTION

Figure 1:
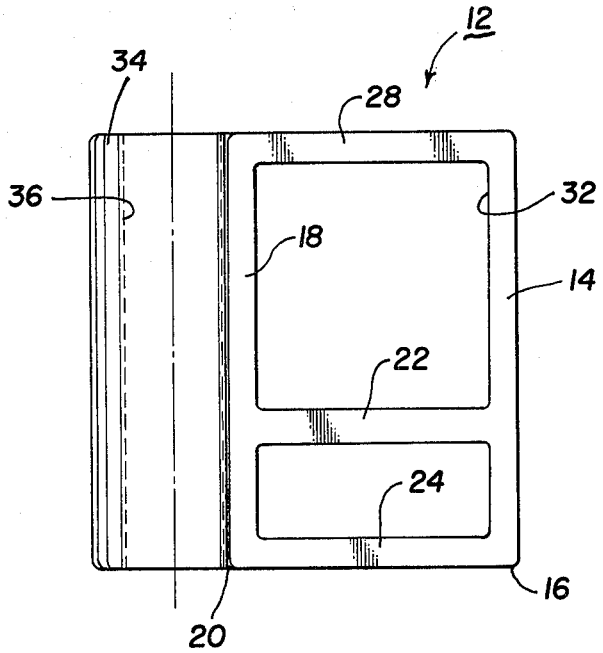
FIG. 1 is a simplified end plan view of the force-bearing structure of the present invention.
Figure 2:
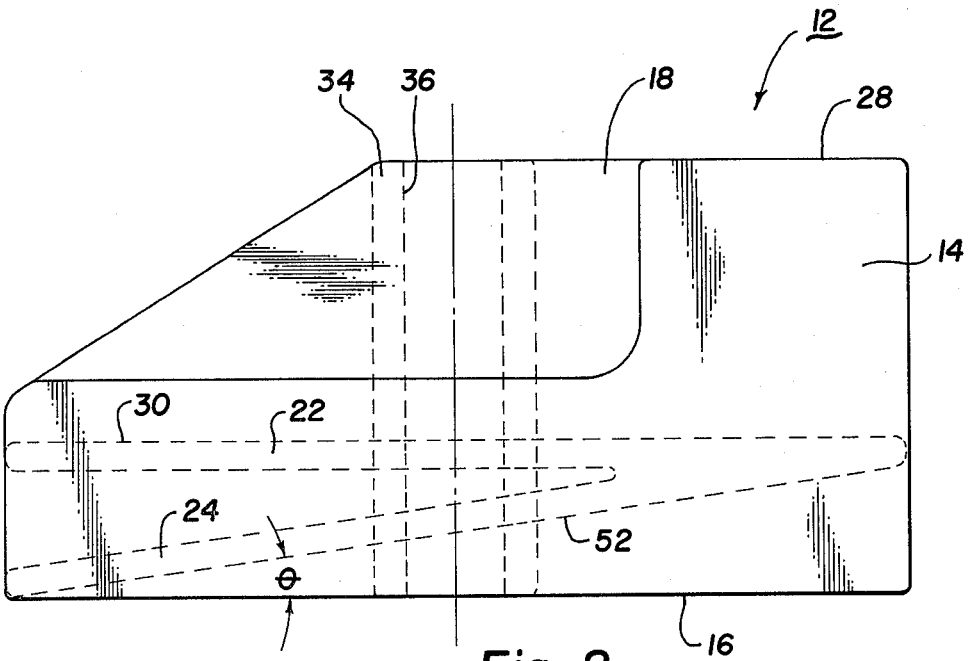
FIG. 2 is a simplified side plan view of the force-bearing structure of the present invention.
Figure 3:
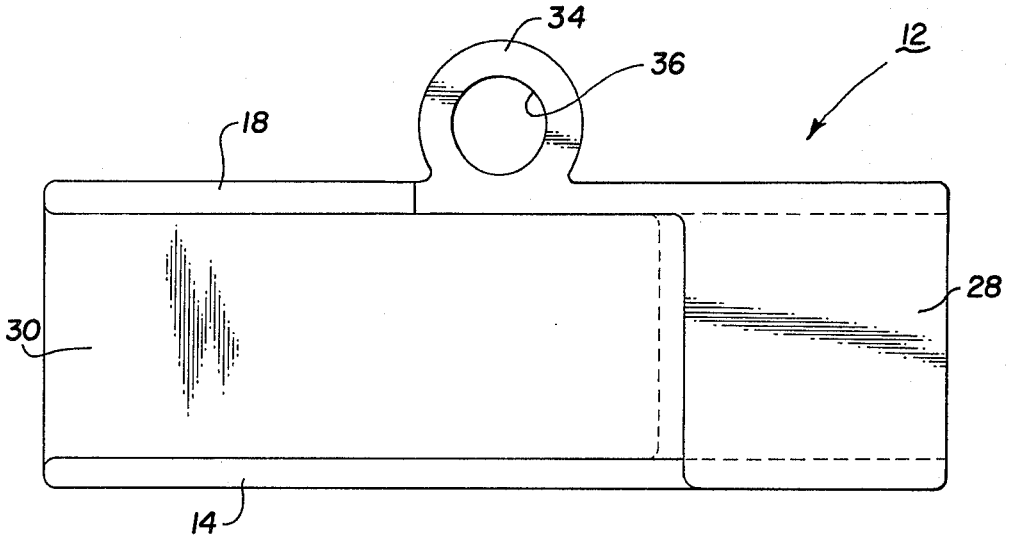
FIG. 3 is a simplified top plan view of the force-bearing structure of the present invention.

Referring now to the drawing wherein like reference numerals designate like or corresponding elements throughout the several views, a leveling and locating or positioning device according to the present invention for leveling and locating the pool wall portion of the modular component type swimming pool is generally referred to by reference numeral 10. The leveling and locating or positioning device 10 is shown comprising a force-bearing structure 12 which is generally rectangular and box-like in shape and includes s first wall means 14 extending in a first plane. Lower edge 16 of first wall means 14 defines s substantially straight line only for manufacturing ease. In the disclosed embodiment, first wall means 14 comprises a generally flat wall panel which is generally L-shaped in side profile and is approximately 6 inches in length by 3 inches in height. Operatively associated with the first wall means 14 is second wall means 18 extending in a second plane which is substantially parallel to said first plane. Lower edge 20 of second wall means 18 defines a substantially straight line only for manufacturing ease and is not mandatory for functional reasons. The straight lines defined by lower edges 16 and 20 both lie generally in a third plane. In the disclosed embodiment, second wall means 18 comprises a generally flat wall panel which is generally trapezoidal in side profile and is approximately 6 inches in length by 3 inches in height.

A first floor means 22 operatively extends between the first wall means 14 and the second wall means 18 to provide a support floor therebetween. The first floor means 22 extends in a fourth plane which is substantially at right angles to said first and said second planes and is substantially parallel to said third plane. In the disclosed embodiment, the first floor means 22 comprises a generally flat rectangular panel which is approximately 6 inches by 1.75 inches. A second floor means 24 operatively extends between the first wall means 14 and the second wall means 18 to provide an additional support means therebetween. The second floor means 24 extends in a fifth plane which is substantially at right angles to said first and said second planes and is at an angle $\theta$ other than a right angle to said fourth plane. In the disclosed embodiment, the second floor means comprises a generally flat rectangular panel which is approximately 6.25 inches by 1.75 inches. Second floor means 24 is positioned on a first or bottom side of first floor means 22 and is at an angle $\theta$ with respect to the first floor means 22 and the fourth plane. In the disclosed embodiment, the preferred angle $\theta$ of second floor means 24 to the first floor means 22 and the fourth plane is 7 degrees and 45 minutes.

A first ceiling means 28 operatively extends between the first wall means 14 and the second wall means 18 to provide a support ceiling or bridge surface therebetween. The first ceiling means 28 extends in a sixth plane which is substantially at right angles to said first and said second planes and is substantially parallel to said fourth plane. In the disclosed embodiment, the first ceiling means 28 comprises a generally flat substantially square panel which is approximately 1.75 inches by 1.75 inches. First ceiling means 28 is positioned on a second or top side 30 of first floor means 22.

Aperture or housing means 32 is formed by the inside surface closure outlined by first wall means 14, second wall means 18, first floor means 22 and first ceiling means 28. In the disclosed embodiment, aperture or housing means 32 is substantially square and measures approximately 1.56 inches by 1.56 inches to allow a standard 2×2 piece of lumber to be inserted therein and rest on first floor 22 with first ceiling means 28 being positioned across the top of the 2×2.

A cylindrical housing 34 containing aperture 36 is operatively positioned and attached to second wall means 18 such that the center line of aperture 36 is substantially at right angles to said fourth plane. Cylindrical housing 34 is attached to the side of second wall means 18 which is opposite from the side of second wall means 18 which forms part of aperture 32. In the disclosed embodiment, the diameter of aperture 36 is approximately 0.800 inches such that a standard ¾ inch diameter rod may be inserted through aperture 36.

During the actual leveling and locating operation, a tapered wedge means 38, a vertical reference means 40, a horizontal extender means 42, support means 44 and fastening means 46 and 47 are used in conjunction with force-bearing structure 12 to level and position the desired item. Details of the leveling and locating operation will be disclosed below with reference to the panel sections which make up the pool wall.

Again, with reference to the construction and placement of the modular component swimming pool, the final deck level or surface grade of the site chosen for the pool is established. The pool perimeter profile is then laid-out on the surface grade. Excavation of the pool area within the perimeter profile, together with the 12 inch to 36 inch overdig shelf-type area is completed. On the shelf-type area, a second peripmeter which is approximately 5 inches outside (larger) the excavated pool perimeter, is established. Along this second perimeter line, at intermittent and generally periodic positions, locations are tamped generally firm and flat to provide a base foundation on which to locate the leveling and locating devices. The number of and the resulting distance between tamped areas primarily depends upon the soil condition and the structural span capability of the wall components, but would normally be 4 to 10 feet between tamped areas. These tamped areas should be at a height which is approximately plus or minus 1 inch of each other. This tolerance is well within easily achievable construction tolerances.

Figure 4:
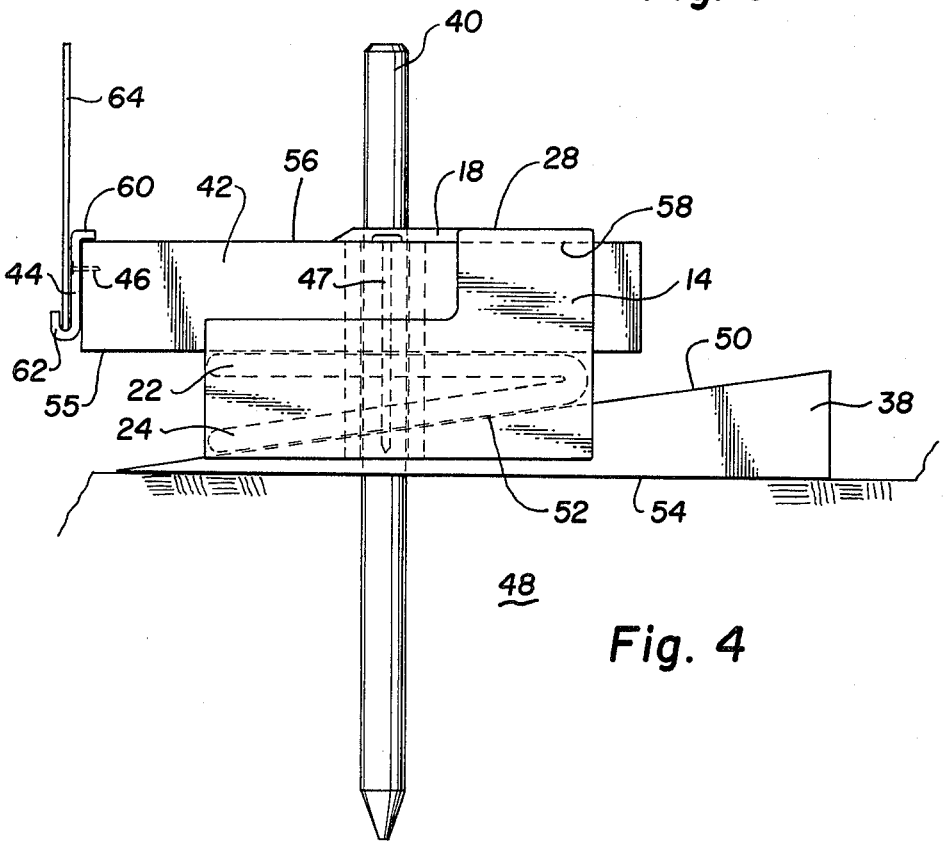
FIG. 4 is a simplified side plan view of the present invention in an operating environment.

With reference to FIG. 4, a vertical reference means 40 is positioned or driven securely into the earth at each of the tamped footing locations 48 along the perimeter line. In the disclosed embodiment, vertical reference means 40 comprises a ¾ inch diameter steel rod with a length of 18 to 30 inches. Once the vertical reference means 40 are securely positioned in and are protruding vertically above the surface of the footing locations 48, they serve as dimensionally stable, vertical and horizontal anchors and references for the leveling and locating devices 10. The vertical reference means also provides a vertical bearing guide for the vertical adjustment of the vertical position of the leveling and locating device 10. A force bearing structure 12 is positioned down over each vertical reference means 40 such that the vertical reference means 40 protrudes through aperture 36. A tapered wedge means 38 is positioned under force bearing structure 12 such that tapered surface 50 is in contact with the lower or bottom surface 52 of second floor means 24. The lower edge portions of first wall means 14 and second wall means 18 extend downwardly on either side of tapered wedge means 38. Lower surface 54 rests against the earth at the tamped footing location 48. In the disclosed embodiment, tapered wedge means 38 comprises a wedge portion formed from a section of a 2×2 or 2×4 piece of lumber. The slope of the tapered surface 50 is substantially equal to the slope of second floor means 24.

Horizontal extender means 42 is positioned such that it extends through aperture or housing means 32 with a portion of the lower or bottom surface 55 of the horizontal extender means 42 resting on the second or top side 30 of first floor means 22. A portion of the upper or top surface 56 of the horizontal extender means 42 is in position to contact the lower or bottom surface 58 of first ceiling means 28. In the disclosed embodiment, the horizontal extender means 42 comprises an 8 to 10 inches portion of a wooden 2×2. Attached to the end of horizontal extender means 42, which is nearest the pool excavation, by fastening means 46 is support means 44. Support means 44 can be an included profile/retainer in the body of the extender 42. Support means 44 is configured to a shape which conforms to and supports the shape of the particular item or element which is to be leveled and positioned by each leveling and locating device 10. In the disclosed embodiment, support means 44 comprises a generally thin shaped piece of metal with lip 60 resting on the upper or top surface 56 of horizontal extender means 42 and a U-shaped trough 62 at the opposite and lower end of support means 44. The lower edge of pool wall panel 64 will rest in the U-shaped trough 62. Fastening means 46 maintains support means 44 against the end of horizontal extender means 42. In the disclosed embodiment, fastening means 46 comprises a nail or screw.

Figure 5:
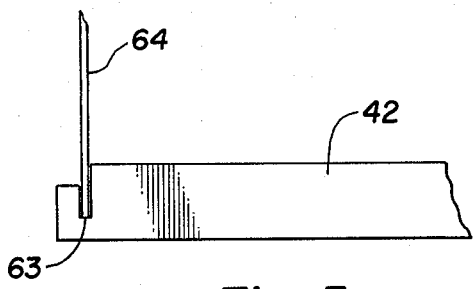
FIG. 5 is a simplified side view plan of an end portion of the horizontal extender means showing one embodiment of an integrally formed support means.
Figure 6:
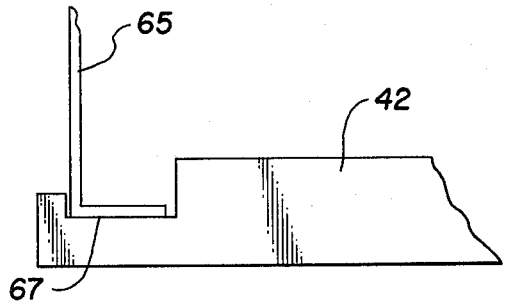
FIG. 6 is a simplified side plan view of an end portion of the horizontal extender means showing another embodiment of an integrally formed support means.

It will be appreciated that support means 44 can be integrally formed as a part of horizontal extender means 42 as well as being a separate item mounted to the horizontal extender means 42. With reference to FIG. 5, horizontal extender means 42 is disclosed with trough 63 integrally formed in the horizontal extender means 42. Trough 63 is narrow in width to accommodate a pool panel 64 without a bottom flange formed thereon. With reference to FIG. 6, horizontal extender means 42 is disclosed with trough 67 integrally formed in the horizontal extender means 42. Trough 67 is a much wider trough than trough 63 and will accommodate a pool panel 65 which includes a bottom flange 66 thereon. Bottom flange 66 may range from 1½ inches to 4 inches.

The actual leveling and locating or positioning function, as related to the pool wall sections, may be accomplished along different concepts or ways. First, using a transit or contractors level, the bottom surface of each support means 44 can be adjusted to a predetermined height, by moving tapered wedge means 38 toward or away from the pool excavation area to move the force-bearing structure 12 (together with support means 44) up or down, respectively. Tapered wedge means 38 may be moved by tapping same with a hammer or sledge. In the disclosed embodiment, approximately ⅛ inch of vertical adjustment of support means 44 is achieved by approximately 1 inch of horizontal movement of tapered wedge means 38 for an angle $\theta$ equal to approximately 7 degrees and 45 minutes. It will be appreciated that if the value of the angle $\theta$ is changed, that the ratio of vertical movement to horizontal movement will equal the ratio of the value of the new angle $\theta$ to 7 degrees and 45 minutes. Additional vertical adjustment can be achieved by introducing parallel risers under tapered wedge means 38, if necessary. After the vertical adjustment is completed, the horizontal locating or positioning of support means 44 is achieved by sliding the horizontal extender means 42 toward or away from the pool excavation perimeter until the support means 44 align with the desired pool perimeter to provide a smooth pool wall surface. After both the final elevation (level) adjustment and the wall perimeter alignment (locating or positioning) adjustments are finalized, fastening means 47 is positioned through the horizontal extender means 42, first floor means 22, second floor means 24 and tapered wedge means 38 to firmly lock the entire assembly at its final set position. Fastening means 47 does not pass through ceiling means 28. Preformed apertures may be positioned at various locations along the horizontal extender means 42 to allow easy use of fastener means 47. In the disclosed embodiment, fastening means 47 comprises a nail or screw. The pool wall panels 64 are then fastened together to form the assembled wall system and the wall system is placed into support means 62. The total concrete footings are then poured around the leveling and locating device, the braces, the wall system, etc.

Another concept or way of actually leveling and locating or positioning the pool wall sections is to perform the same steps of setting up the vertical reference means 40, the force-bearing structure 12, the tapered wedge means 38, the horizontal extender means 42 and the support means 44 as was disclosed previously. Also perform the vertical adjustment of the support means 44 and the horizontal locating or positioning of support means 44 as before. Then pour the concrete footings around each leveling and locating device 10 to secure the devices in place and provide a positive means to accomplish an accurate perimeter control (locating) and an accurately leveled total system assembly. Once the concrete footing pour has adequately set and at least partially cured, the vertical reference means 40 can be removed and then reused on subsequent installations. If care is exercised, accuracies of ±0.15 inch vertically, can be fairly easily achieved. The perimeter or location settings will be as accurate as the layout measurements and guidelines. After the concrete footing pour has cured, then place the assembled wall system into place in the support means 62.

Another concept or way of actually leveling and locating or positioning the pool wall sections is to perform the same steps of setting up the vertical reference means 40, the force-bearing structure 12, the tapered wedge means 38, the horizontal extender means 42 and the support means 44 as was disclosed previously. Also perform the vertical adjustment of the support means 44 and the horizontal locating or positioning of support means 44 as before. Then the entire pool bottom is placed and poured, including the concrete footing pour to secure the leveling and locating device 10. After the concrete is cured, the assembled wall system is placed in operative position in support means 62. Then the pool wall system is sealed to the pool floor by any of a variety of sealant systems.

It will be appreciated that the various elements of the leveling and locating device 10 could be made from wood, plastic or metal or a combination of the three materials. For reasons of cost, in the disclosed embodiment, the vertical reference means 40 is metal, the force-bearing structure 12 is a molded plastic, the tapered wedge means 38 is wood, the horizontal extender means 42 is wood, the support means 44 is metal and fasteners 46 and 47 are metal.

Thus it is apparent that there has been provided in accordance with this invention, a leveling and locating or positioning device that substantially incorporates the advantages set forth above. Although the present invention has been described in conjunction with specific forms thereof, it is evident that many alternatives, modifications, and variations will be apparent to those skilled in the art in light of the foregoing disclosure. Accordingly, this description is to be construed as illustrative only and is for the purpose of teaching those skilled in the art the manner of carrying out the invention. It is understood that the forms of the invention herewith shown and described are to be taken as the presently preferred embodiments. Various changes may be made in the shape, size and arrangement of parts. For example, equivalent elements may be substituted for those illustrated and described herein, parts may be reversed, and certain features of the invention may be utilized independently of the use of other features, all as would be apparent to one skilled in the art after having the benefit of this description of the invention. It will be appreciated that the various modifications, alternatives, variations, etc. may be made without departing from the spirit and scope of the invention as defined in the appended claims.

What is claimed is:

1. In a leveling and locating apparatus for vertically and horizontally positioning a member with respect to the earth, a force-bearing structure comprising:

a first wall means extending in a first plane;

a second wall means extending in a second plane, said second plane being substantially parallel to said first plane;

a first floor means operatively extending between said first and second wall means, said first floor means extending in a third plane which is at substantially right angles to said first and second planes;

a second floor means operatively extending between said first and second walls means, said second floor means extending in a fourth plane which is at substantially right angles to said first and second planes and is at a predetermined angle $\theta$ to said third plane, said predetermined angle $\theta$ being other than zero degrees, said second floor means being positioned on a first side of said first floor means;

a ceiling means operatively extending between said first and second wall means, said ceiling means extending in a fifth plane which is at substantially right angles to said first and second planes and is substantially parallel to said third plane, said ceiling means being positioned on a second side of said first floor means;

a first housing means, with opposed open ends, operatively attached to a first side of said second wall means and operatively positioned such that a centerline thereof is at substantially right angles to said first floor means, whereby said force bearing structure may be moved vertically along a vertical reference, by a force applied in a vertical direction to said second floor means.

2. Apparatus according to claim 1, further including:

a vertical reference means operatively positioned through said opposed open ends of said first housing means, said vertical reference means being removably attached to a substantially level area of said earth and aligned vertically with respect to said earth to guide said force-bearing structure during vertical movement thereof.

3. Apparatus according to claim 2, further including:

a tapered wedge means operatively positioned between said force-bearing structure and said substantially level area of said earth, said tapered wedge means operatively contacting said second floor means to provide a force to said force-bearing structure to move said force-bearing structure in a vertical direction when said tapered wedge means is moved in a horizontal direction along said substantially level area of said earth.

4. Apparatus according to claim 3, further including:

a horizontal extender means operatively positioned within a second housing means for sliding movement therein in a horizontal direction, said second housing means being defined by said first wall means, said second wall means, said first floor means and said ceiling means, and support means operatively associated with said horizontal extender means and configured to receive a portion of said member to be leveled vertically and located horizontally.

5. Apparatus according to claim 3, wherein said tapered wedge means operatively contacts said second floor with a surface which is positioned at an angle $\theta$ to said third plane.

6. Apparatus according to claim 4, further including fastening means to operatively contact and anchor together said force-bearing structure, said horizontal extender means and said tapered wedge means to prevent further movement thereof after the leveling and locating movement has been completed.

7. In a leveling and locating apparatus for vertically and horizontally positioning, with respect to the earth, a wall of a modular type swimming pool, said apparatus comprising:

a vertical reference means removably attached to a predetermined level area of said earth, said vertical reference means being aligned vertically with respect to said earth;

a force-bearing structure operatively positioned with respect to said vertical reference means for vertical movement with respect thereto;

a tapered wedge means operatively positioned between said force-bearing structure and said earth to provide a vertical force to position against said force-bearing structure when said tapered wedge means is moved in a horizontal direction;

a horizontal extender means operatively positioned with respect to said force-bearing structure for horizontal movement with respect thereto;

a support means operatively associated with said horizontal extender means and configured to receive the edge of a wall section of said swimming pool, whereby said wall section is leveled by vertical movement of said force-bearing structure resulting from the horizontal movement of said tapered wedge means and is horizontally positioned by the horizontal movement of said horizontal extender means with respect to said force-bearing structure.

8. The apparatus of claim 7, further including fastening means to operatively contact and anchor together said force-bearing structure, said horizontal extender means and said tapered wedge means to prevent further movement thereof after the leveling and locating movement has been completed.

9. The apparatus of claim 7, wherein said force-bearing structure comprises:

a first wall means extending in a first plane;

a second wall means extending in a second plane, said second plane being substantially parallel to said first plane;

a first floor means operatively extending between said first and second wall means, said first floor means extending in a third plane which is at substantially right angles to said first and second planes;

a second floor means operatively extending between said first and second wall means, said second floor means extending in a fourth plane which is at substantially right angles to said first and second planes and is at a predetermined angle $\theta$ to said third plane, said predetermined angle $\theta$ being other than zero degrees, said second floor means being positioned on a first side of said first floor means;

a ceiling means operatively extending between said first and second wall means, said ceiling means extending in a fifth plane which is at substantially right angles to said first and second planes and is substantially parallel to said third plane, said ceiling means being positioned on a second side of said first floor means; and a first housing means with opposed open ends, operatively attached to a first side of said second wall means and operatively positioned such that a centerline thereof is at substantially right angles to said first floor means, said first wall means, said second wall means, said first floor means and said ceiling means forming a second housing means with opposed open ends.

10. A method for leveling and horizontally locating, with respect to the earth and a pool perimeter, a wall of a modular type swimming pool, said method comprising the steps of:

laying out a perimeter line, on the earth's surface, a predetermined distance outside the pool perimeter;

level predetermined areas at intermittent and generally periodic positions along the perimeter line laid out in the previous step;

position a vertical reference at each of the predetermined areas of the previous step;

operatively position a force-bearing structure with respect to each said vertical reference means such that said force-bearing structure is guided in vertical movement by said vertical reference means;

operatively position a tapered wedge means between each said force-bearing structure and said earth such that said force-bearing structure is capable of moving vertically upon the horizontal movement of said tapered wedge means;

operatively position a horizontal extender means with respect to each said force-bearing means for relative horizontal movement with respect to and support therefrom said force-bearing means;

operatively mount a support means, configured to support one of said wall sections, to each said horizontal extender means;

vertically move each force-bearing structure by horizontally moving each associated tapered wedge means until all support means are at a predetermined height with respect to a level reference; and horizontally move each horizontal extender means until each support means is in line with said pool perimeter.

* * * * *